US008667789B2

(12) United States Patent
Thelen et al.

(10) Patent No.: US 8,667,789 B2
(45) Date of Patent: Mar. 11, 2014

(54) HYDRAULIC PRESSURE SUPPLY UNIT FOR A POWER SCREWDRIVER

(75) Inventors: Bernd Thelen, Much (DE); Ulf Sittig, Nümbrecht (DE); Günter Andres, Much (DE)

(73) Assignee: Wagner Vermogensverwaltungs-GmbH & Co. KG, Much (DE)

( * ) Notice: Subject to any disclaimer, the term of this patent is extended or adjusted under 35 U.S.C. 154(b) by 847 days.

(21) Appl. No.: 12/922,309

(22) PCT Filed: Mar. 11, 2009

(86) PCT No.: PCT/EP2009/052850

§ 371 (c)(1),
(2), (4) Date: Sep. 13, 2010

(87) PCT Pub. No.: WO2009/112517

PCT Pub. Date: Sep. 17, 2009

(65) Prior Publication Data

US 2011/0005221 A1 Jan. 13, 2011

(30) Foreign Application Priority Data

Mar. 12, 2008 (DE) ..... 20 2008 003 500 U

(51) Int. Cl.
*B25B 21/00* (2006.01)

(52) U.S. Cl.
USPC ..... 60/420; 60/484; 81/57.38

(58) Field of Classification Search
USPC ..... 60/420, 422, 484; 91/536; 81/54, 57.38
See application file for complete search history.

(56) References Cited

U.S. PATENT DOCUMENTS

| | | | | |
|---|---|---|---|---|
| 4,523,742 | A * | 6/1985 | Reneau | 81/57.38 |
| 5,394,693 | A * | 3/1995 | Plyter | 60/325 |
| 6,341,953 | B1 * | 1/2002 | Okubo et al. | 425/145 |
| 7,200,992 | B2 * | 4/2007 | Wagner | 60/379 |
| 7,493,757 | B2 * | 2/2009 | Kurz et al. | 60/476 |
| 2009/0151517 | A1 * | 6/2009 | Gosling | 81/57.38 |

FOREIGN PATENT DOCUMENTS

| | | |
|---|---|---|
| AT | 8 986 U1 | 3/2007 |
| DE | 102 49 524 A1 | 5/2004 |
| GB | 1 393 618 | 5/1975 |
| WO | 01/42663 | 6/2001 |

OTHER PUBLICATIONS

English translation of the International Preliminary Report on Patentability (Form PCT/IB338) corresponding application No. PCT/EP2009/052850 dated Oct. 14, 2010.
International Search Report for corresponding application No. PCT/EP2009/052850 dated May 19, 2009.

* cited by examiner

*Primary Examiner* — Thomas E Lazo
(74) *Attorney, Agent, or Firm* — Renner, Otto, Boisselle & Sklar LLP

(57) ABSTRACT

The pressure supply unit has a pressure generating aggregate (10), which generates a supply pressure (PL) for the intermittent operation of a power screwdriver (11). So as to allow also a tensioning cylinder unit (33) to be operated alternatively to the power screwdriver (11), which requires higher pressure, a pressure intensifier (30) is provided which is included in a separate module (31) and generates high pressure (PH) from the supply pressure (PL). The reversal of the pressure intensifier (30) for carrying out strokes is achieved by the same stroke switch valve (20) which otherwise performs the reversal of the power screwdriver (11).

6 Claims, 3 Drawing Sheets

HYDRAULIC PRESSURE SUPPLY UNIT FOR A POWER SCREWDRIVER

Figure 1:
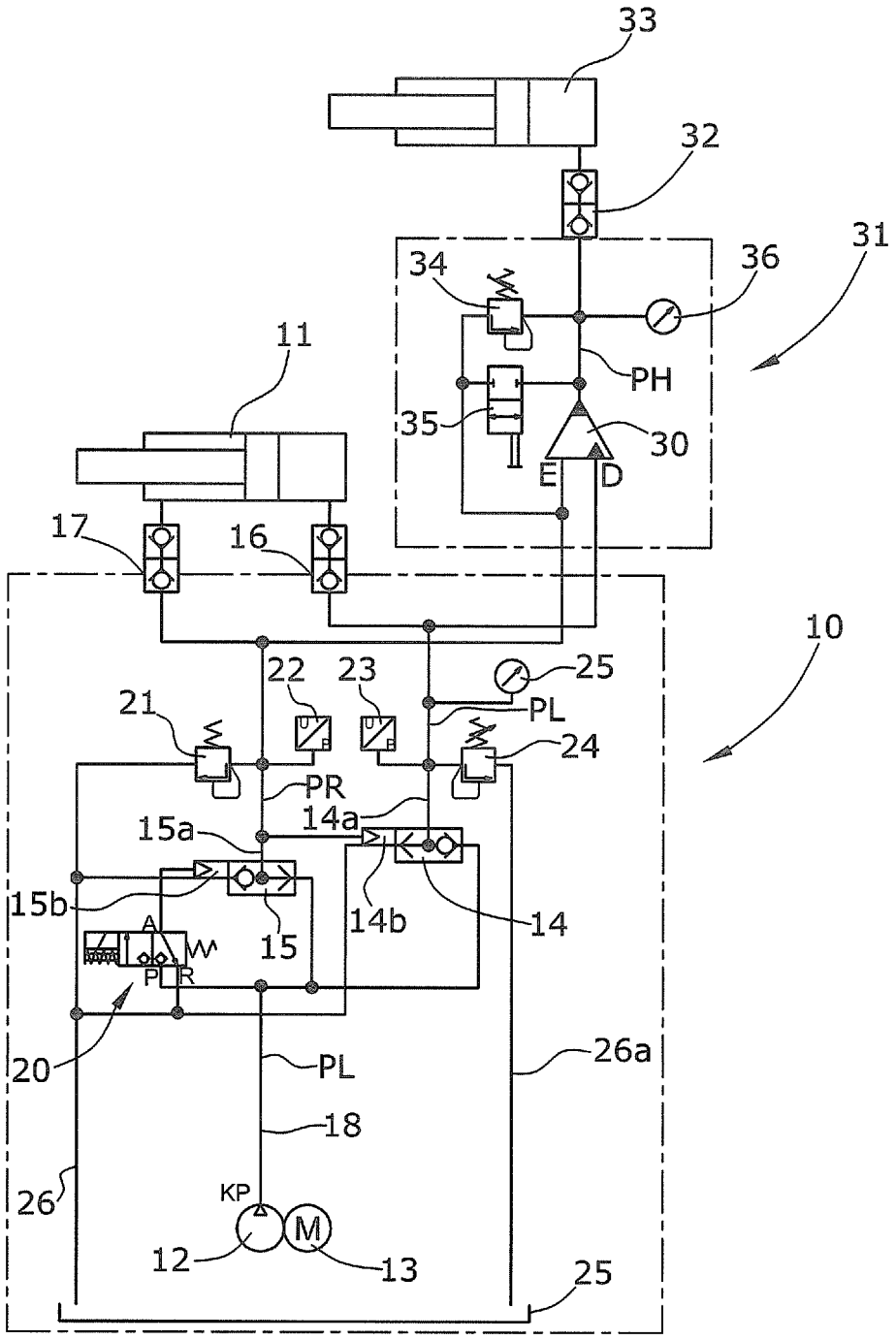

The invention relates to a hydraulic pressure supply unit for a power screwdriver, said hydraulic pressure supply unit comprising

- a pressure generating aggregate generating a supply pressure,
- a stroke control unit for supplying the supply pressure alternately to a first connector and a second connector and for connecting the respective other one of said two connectors to a return line.

A pressure supply unit of the above type is described in WO 03/097304 A1 (Wagner). The two connectors of the pressure supply unit are provided for connection to the cylinder of a power screwdriver. Thereby, the piston arranged in said cylinder will be driven in a reciprocating manner, thereby turning, via a ratchet mechanism, the screw which is to be rotated in steps. The switching between the connectors is performed by a stroke control unit in dependence of the change of the hydraulic pressure measured in time intervals. The working process will be terminated when, within a predetermined period, the rise of the hydraulic pressure in a load stroke has dropped below a predetermined limiting value. According to another approach, it is provided that, in the load stroke, the change of the hydraulic pressure over time will be measured in time intervals, and that a switching to return stroke will be performed when at least in one of the time intervals the pressure is by a certain amount higher than in at least one of the preceding intervals of the work process.

In screw connection technology, a distinction is made between screwing methods and tensioning methods. In a screwing method, as described in WO 03/097304 A1, a screw is rotated by application of hydraulic force. For this purpose, use is normally made of piston/cylinder units. The pressure is in a range up to 800 bar. In a tensioning method, as described in U.S. Pat. No. -4,246,810, a screw bolt will be stretched by an axial pretensioning force so that the nut seated on the bolt can be easily rotated. Tensioning methods are used with a hydraulic high pressure of up to 2000 bar. Both systems require hydraulic aggregates for generating the corresponding pressures. For each of said two screw connection methods, there is thus used an individual pressure supply unit specially designed for the respective method.

A hydraulic supply unit comprising a pressure generator and a pressure intensifier for high-pressure application is described in DE 102 49 524 B4. The pressure intensifier is arranged in the extension of the pressure generator and in a common housing with the pressure generator. Thus, the user will always have to carry along the whole unit.

It is an object of the invention to provide a hydraulic pressure supply unit which is adapted to selectively deliver a supply pressure for the screwing method or a high pressure for a high-pressure application.

The pressure supply unit of the invention is defined by claim 1. It is characterized in that a pressure intensifier is provided which comprises a first piston member having a larger diameter and a second piston member having a smaller diameter, said first piston member being alternately controlled by the pressures of said first and said second connector, and said second piston member being operative to generate, at a high-pressure connector, a high pressure which is higher than said supply pressure, said high-pressure connector being adapted for connection of a high-pressure device thereto.

The invention offers the advantage that the same hydraulic pressure supply unit can be used for the screwing method and for a high-pressure application, e.g. the tension method. For the tensioning method, it is merely required to additionally utilize the pressure intensifier which would be inactive in the screwing method. Thus, the user will have to buy only a single appliance which is suited for both of said screw connection methods, i.e. for a screw-rotating drive or for a tensioning device. In operation with activated pressure intensifier, the reversal of the piston of the pressure intensifier is achieved by the same stroke control unit which also performs the stroke control for the screwing operation. Thus, no additional stroke control unit is required for the pressure intensifier. As a result, the pressure intensifier can consist of a relatively simple and inexpensive part without a control unit of its own.

With the pressure supply unit of the invention, it is rendered possible for the user to employ the same appliance for both of said screw connection methods. This allows for a reduction of the equipment costs incurred to the user. The additional pressure intensifier is operative without a stroke control unit of its own for performing the alternating movement of the intensifier piston. The pressure supply unit of the invention is of a compact design, has a low weight and consists of a merely small number of components. Using the system of the invention, one or a plurality of hydraulic working devices can be operated simultaneously.

Preferably, said pressure intensifier is included in a separate module which is removably attached to said pressure generating aggregate. The pressure intensifier is a supplementary module which can be optionally mounted in situations where the pressure supply unit is intended to be used for a tensioning device. The pressure intensifier module does not include a stroke control unit of its own but instead will use that of the base appliance. Further, connection of the pressure intensifier module to the base appliance can be provided in different ways. These include direct coupling to the base appliance, connection via hydraulic connector pieces and connection via longer hose or tube conduits, wherein the pressure intensifier module is an appliance which can be placed independently from other units.

According to a preferred embodiment of the invention, the stroke control unit includes a stroke switch valve for performing the switching of the supply pressure between the first and second connectors in dependence on the pressure change over time. Control herein can be performed according to any one of the methods described in WO 03/097304 A1. Alternatively or additionally thereto, said stroke switch valve can be actuated manually, either directly or via radio transmission.

Setting the high pressure is preferably performed at a pressure limiting valve adapted to set the supply pressure. The high pressure differs from the supply pressure by a factor which is preset by design. Said pressure limiting valve makes it possible to vary, on the one hand, the supply pressure in a screwing method and, on the other hand, the high pressure in a screwing method. Thus, for setting the two pressures, only one pressure limiting valve is required.

On the pressure intensifier, a relief valve should be provided which is openable by hand and in the opened state will connect the first connector to the high-pressure connector.

A preferred embodiment of the invention comprises a control unit which, during operation of the bolt tensioning device with high pressure, will continuously add up the number of the working strokes in order to detect the lapse of a maintenance interval. Herein, continuous counting of the working strokes is performed. For critical components which are operated with high pressure, the allowable period of use is limited by a preset limiting number of strokes. Normally, the number of strokes is measured by a mechanical counter. By the invention, it is rendered possible in an easy manner to realize the counting of the number of strokes without the need for additional components.

An embodiment of the invention will be explained in greater detail hereunder with reference to the drawings.

Figure 2:
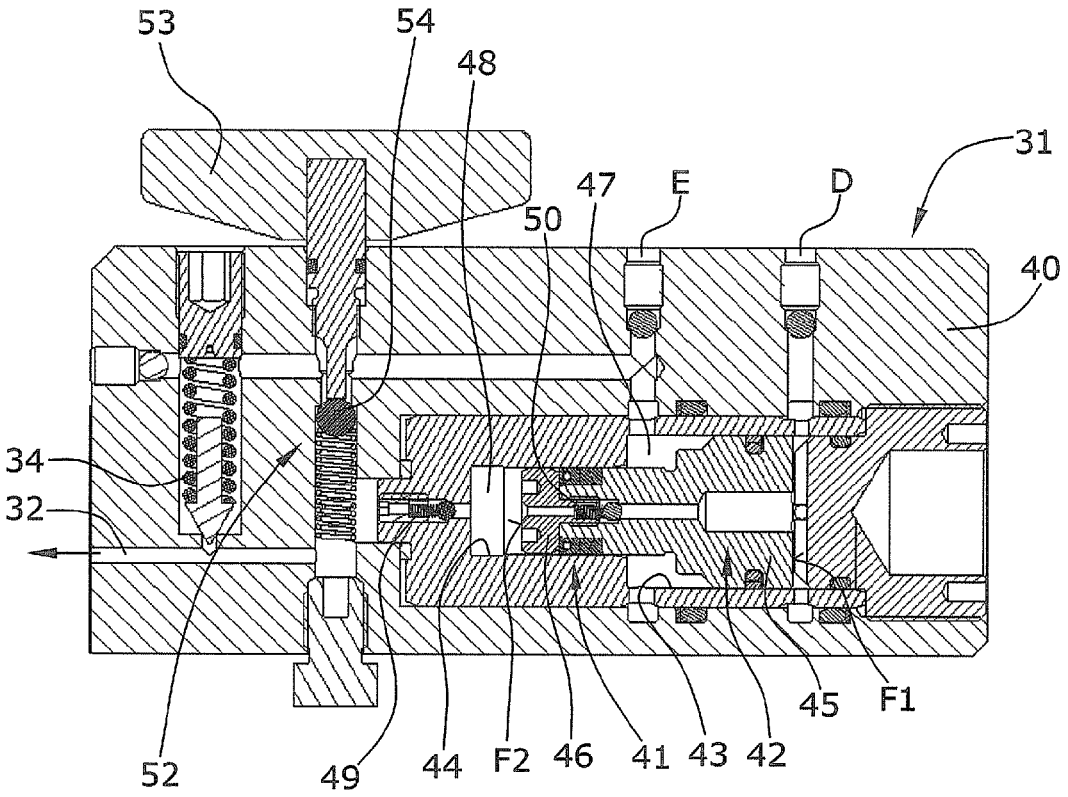
Figure 3:
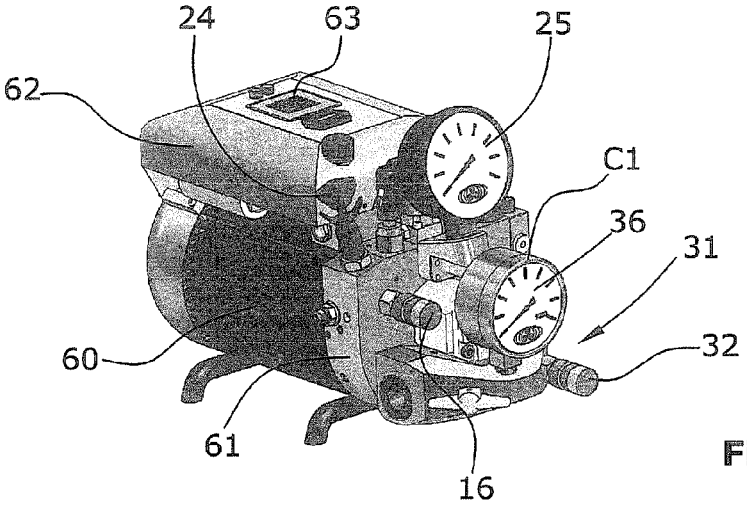
Figure 4:
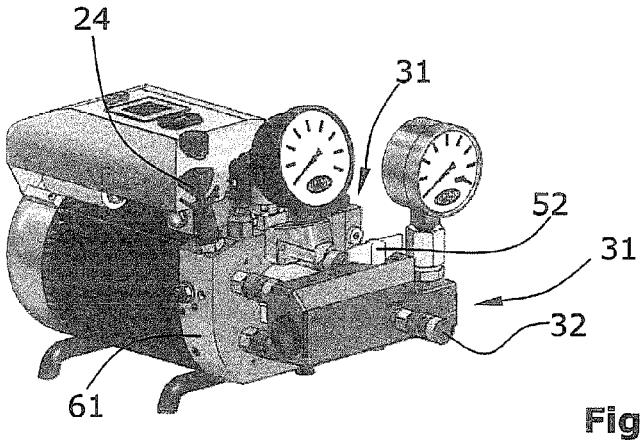
Figure 5:
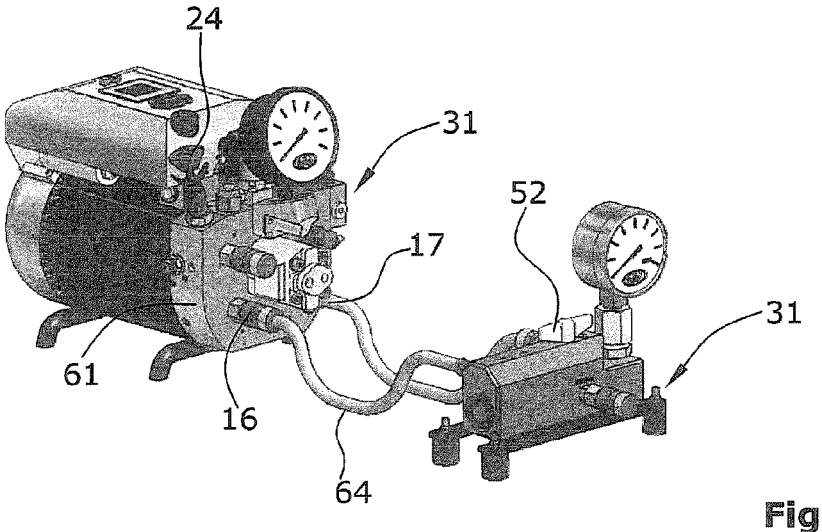

In the drawings, the following is shown:

FIG. 1 is a hydraulic diagram of the pressure supply unit with pressure intensifier, FIG. 2 is a sectional view of the pressure intensifier, and FIGS. 3, 4, 5 are views of different options of connecting the pressure intensifier to the base appliance and respectively the pressure generating aggregate of the pressure supply unit.

According to FIG. 1, a pressure generating aggregate 10 is provided which is operative to generate a supply pressure for power screwdriver 11 which herein is represented by a piston-cylinder unit. Said pressure generating aggregate 10 includes a pump 12 which is driven by a motor 13 and will pump hydraulic fluid from a tank 25 so as to generate a pressure. Said pressure is supplied to an input of a switch valve 14 for advance movement and to the input of a switch valve 15 for return movement. Switch valve 14 comprises an outlet 14*a* connected to a first connector 16. Switch valve 15 comprises a first outlet 15*a* connected to a second connector 17. Said connectors 16 and 17 are couplings for establishing a hydraulic coupling connection to power screwdriver 11. Control of switch valves 14 and 15 is carried out by a respective control cylinder 14*b*, 15*b*. Control cylinder 14*b* is controlled by the pressure on outlet 15*a*. Control cylinder 15*b* is controlled by a stroke switch valve 20 which is magnetically actuated in dependence on the signals of a control unit. The stroke switch valve is operative to the effect that, in a first position (shown in FIG. 1), control cylinder 15*b* will be connected to the return line 26 and, in a second position, control cylinder 15*b* will be connected to the pressure line 18 of pump 12.

Said outlet 15*a* of switch valve 15 is connected to the return line 26 via a pressure limiting valve 21 for the back pressure, which valve is set to 100 bar. Said outlet 14*a* of switch valve 14 is connected to a further return line 26*a* via a settable pressure limiting valve 24 which can be set in a range between 0 and 800 bar. Said pressure limiting valve 24 generates a supply pressure PL which will be supplied to connector 16. At connector 17, a return pressure PR is generated which is delimited by pressure limiting valve 21.

In the first position of said stroke switch valve 20, its connector A is connected to the return connector R while the connector P is blocked. In this state, the connector 16 of pressure generating aggregate 10 is pressureless, and connector 17 is pressurized. In the second position of stroke switch valve 20, connectors P and A are connected to each other whereas connector R is blocked. In this state, connector 17 is connected to the tank and connector 16 is pressurized.

Connector 17 is connected to a pressure transducer 22, and connector 16 is connected to a pressure transducer 23. The electric signals which correspond to the pressures are supplied to the control unit which will control the stroke switch valve 20 in dependence thereon. Control of power screwdriver 11 is performed in dependence on the pressures of pressure transducers 22 and 23 in the manner described in WO 03/097304 A1 which herewith is incorporated into the present description by reference.

The pressure generating aggregate 10 as described so far, is known. According to the invention, a pressure intensifier 30 is provided which is included in a separate module 31. Module 31 comprises a high-pressure connector 32 adapted for connection of a high-pressure device thereto, the latter being a tensioning cylinder unit 33 in the case shown herein. Said tensioning cylinder unit 33 is operated by a pressure which is considerably higher than that of power screwdriver 11. For this reason, the high pressure PH is generated by pressure intensifier 30. While the supply pressure is varying from 0 to 800 bar, the high pressure PH can be up to 2000 bar. For limiting the high pressure PH, use is made of a pressure limiting valve 34. A manually operable unlocking valve 35 serves for relief of high-pressure connector 32 so as to render the tensioning cylinder pressureless.

Pressure intensifier 30 comprises a connector D connected to the connector 16 of the pressure generating aggregate, and a connector E connected to the connector 17 of the pressure generating aggregate. The supply pressure PL will be generated alternately at said connectors E and D while the respective other connector is connected to the return line.

Pressure generating aggregate 10 includes a manometer 25 indicating the supply pressure. Said module 31 includes a manometer 36 indicating the high pressure.

Module 31 with pressure intensifier 30 is depicted in FIG. 2. This module comprises a block 40 accommodating a cylinder 41 with an intensifier piston 42 displaceably arranged therein. Said cylinder 41 has a large cylinder bore 43 followed by a small cylinder bore 44. Said intensifier piston 42 comprises a first piston member 45 of a large diameter and a second piston member 46 of a small diameter. The piston face of said first piston member 45 is F1, and the piston face of said second piston member 46 is F2. The surface areas of F1 and F2 have a ratio of 3:1 relative to each other. A cylinder chamber delimiting said piston face F1 is connected to connector D. The rear space 47 is connected to connector E. Said small piston face F2 delimits a high-pressure chamber 48 which via a back-check valve 49 is connected to high-pressure connector 32. Extending through intensifier piston 42 is a longitudinal bore with a back-check valve 50 arranged therein. Thereby, the supply pressure acting on piston face F1 will reach the high-pressure side of the piston. Due to said ratio between the surface areas, F1:F2, an increased pressure will be generated in high-pressure chamber 48. By alternating movement of intensifier piston 42, the supply pressure will intensified to the amount of the high pressure.

A relief valve 52, operable by a handle 53, serves for removing the high pressure from the tensioning cylinder unit 33 to relieve the latter. Said relief valve 52 comprises a spring-biased ball which is pressed against a valve seat and which can be removed from the valve seat with the aid of a pin 54 of said handle. In the opened state, relief valve 52 will connect the connector D to high-pressure connector 32, thus relieving the latter towards the return line.

Pressure generating aggregate 10 will be used only in combination with a power screwdriver 11 or with a tensioning cylinder unit 33, but not with both of them together. To the connectors 16,17, there is thus connected either the power screwdriver 11 or the module 31. If it is the module 31 that is connected, the stroke control of the piston 42 of pressure intensifier 30 will be performed by stroke switch valve 20 by use of the same control process as in power screwdriver operation.

FIGS. 3, 4 and 5 show different variants of mounting the module 31 to the pressure generating aggregate. The pressure generating aggregate comprises a housing 60 accommodating the pump 12 and the motor 13. On its front-side end, said housing is closed by a distribution block 61 supporting the valve arrangement shown in FIG. 1. The distribution block also supports said manometer 25. From the outside of the distribution block, the pressure limiting valve 24 is accessible for adjusting the supply pressure PL and thus also the high pressure PH. On its front side, the distribution block comprises the connectors 16 and 17 for selectively connecting thereto a power screwdriver or a module 31. Connectors 16 and 17 can be provided twice, the respectively non-used connectors being closed.

Module 31 comprises said relief valve 52 whose handle is accessible from the outside. Also the high-pressure connector 32 is exposed.

Mounted onto housing 60 is an upper unit 62 accommodating the electronic control unit 63 for controlling the stroke control device with the stroke switch valve 20. Control unit 63 will inter alia receive the signals of the pressure sensors 22 and, when the pressure supply unit is operated with a tensioning cylinder, the control unit will also present an indication of the number of the working strokes performed so far.

FIGS. 3-5 illustrate different ways of mounting the module 31 to the distributor block 61 by direct connection or via hoses 64.

The invention claimed is:

1. A hydraulic pressure supply unit for a power screwdriver, said hydraulic pressure supply unit comprising a pressure generating aggregate generating a supply pressure, a stroke control unit for supplying the supply pressure alternately to a first connector and a second connector and for connecting the respective other one of said two connectors to a return line, wherein a pressure intensifier is provided which comprises a first piston member having a larger diameter and a second piston member having a smaller diameter, said first piston member being alternately controlled by the pressures of said first and second connectors and said second piston member generating, at a high-pressure connector, a high pressure which is higher than said supply pressure, said high-pressure connector being adapted for connection of a high-pressure device thereto.

2. The hydraulic pressure supply unit according to claim 1, wherein said pressure intensifier is included in a separate module which is removably attached to said pressure generating aggregate.

3. The hydraulic pressure supply unit according to claim wherein said stroke control unit includes a stroke switch valve for switching the supply pressure between said first and second connectors in dependence on the change of the pressure over time.

4. The hydraulic pressure supply unit according to claim 1, wherein a settable pressure limiting valve is provided for setting the supply pressure and thereby also the high pressure (PH).

5. The hydraulic pressure supply unit according to claim 1, wherein a relief valve is provided which can be opened manually and in the opened state connects the first connector to the high-pressure connector.

6. The hydraulic pressure supply unit according to claim 1, wherein a control unit is provided which, in operation of the bolt tensioning device with the high pressure, continuously adds up the number of the working strokes for detecting the lapse of a maintenance interval.

* * * * *

UNITED STATES PATENT AND TRADEMARK OFFICE

CERTIFICATE OF CORRECTION

PATENT NO. : 8,667,789 B2
APPLICATION NO. : 12/922309
DATED : March 11, 2014
INVENTOR(S) : Thelen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 850 days.

Signed and Sealed this
Twenty-ninth Day of September, 2015

Michelle K. Lee

Michelle K. Lee
*Director of the United States Patent and Trademark Office*